US009856110B2

(12) United States Patent
Putkinen

(10) Patent No.: US 9,856,110 B2
(45) Date of Patent: Jan. 2, 2018

(54) METHOD AND APPARATUS FOR MONITORING THE LUBRICANT CONTENT OF ELEVATOR ROPES

(71) Applicant: KONE Corporation, Helsinki (FI)

(72) Inventor: Esa Putkinen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 482 days.

(21) Appl. No.: 14/564,929

(22) Filed: Dec. 9, 2014

(65) Prior Publication Data

US 2015/0090537 A1 Apr. 2, 2015

Related U.S. Application Data

(63) Continuation of application No. PCT/FI2013/050728, filed on Jul. 2, 2013.

(30) Foreign Application Priority Data

Jul. 2, 2012 (FI) ..... 20125767

(51) Int. Cl.
*B66B 1/34* (2006.01)
*B66B 5/00* (2006.01)
(Continued)

(52) U.S. Cl.
CPC ..... *B66B 5/0025* (2013.01); *B66B 3/002* (2013.01); *B66B 5/0031* (2013.01); *B66B 7/1215* (2013.01); *B66B 7/1261* (2013.01)

(58) Field of Classification Search
CPC ..... B66B 5/0025; B66B 3/002; B66B 5/0031; B66B 7/1215; B66B 7/1261
(Continued)

(56) References Cited

U.S. PATENT DOCUMENTS 4,538,107 A 8/1985 Varone
5,027,065 A 6/1991 Bares et al.
(Continued)

FOREIGN PATENT DOCUMENTS

EP 1 923 700 A2 5/2008
FI 119238 B 9/2008
(Continued)

*Primary Examiner* — Anthony Salata
(74) *Attorney, Agent, or Firm* — Birch, Stewart, Kolasch & Birch, LLP

(57) ABSTRACT

A method and an apparatus for monitoring and supervising the lubricant content of elevator ropes in an elevator, which includes at least a hoisting machine provided with a drive motor, the hoisting machine including at least a traction sheave, around which one or more elevator ropes are fitted side-by-side, which ropes move under the effect of friction along with the rotational movement of the traction sheave and at the same time move the elevator car. The lubricant content is monitored and supervised by the aid of a magnetic measuring device disposed in the immediate proximity of the traction sheave and the elevator ropes by collecting in the measuring device the metal dust detaching in connection with wear of the traction sheave and of the elevator ropes during operation of the elevator and by letting the metal dust switch on an alarm about a lubricant content of the elevator ropes that is too low.

20 Claims, 2 Drawing Sheets

Figure 1:
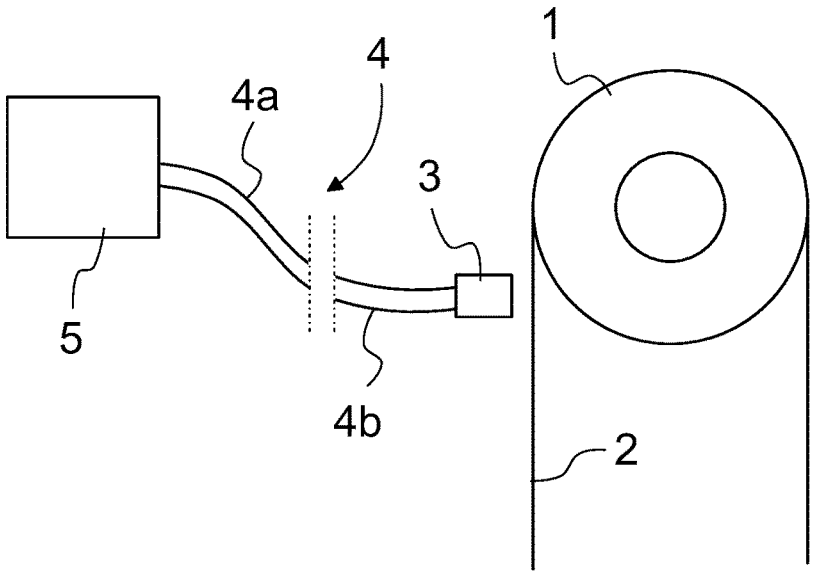

(51) Int. Cl.
*B66B 3/00* (2006.01)
*B66B 7/12* (2006.01)

(58) Field of Classification Search
USPC ..... 187/391, 393, 394; 73/158, 381, 391, 73/473; 324/522, 523, 525, 691, 693
See application file for complete search history.

(56) References Cited

U.S. PATENT DOCUMENTS 5,791,011 A * 8/1998 Richter ..... B66B 7/1284 15/231
6,073,728 A * 6/2000 Olsen ..... B66B 7/123 187/250
6,325,179 B1 * 12/2001 Barreiro ..... B66B 5/0037 187/393
7,123,030 B2 * 10/2006 Robar ..... B66B 7/1223 187/393
7,137,483 B2 * 11/2006 Kato ..... B66B 7/06 187/251
7,637,357 B2 * 12/2009 Nakagawa ..... B66B 5/00 187/393
7,665,179 B2 * 2/2010 Connolly ..... B66B 7/1284 15/256.6
8,011,479 B2 * 9/2011 Stucky ..... B66B 7/1223 187/391
8,317,160 B2 * 11/2012 Romo ..... B66B 11/08 182/142
8,678,139 B2 * 3/2014 Aulanko ..... B66B 7/1261 187/251
8,686,747 B2 * 4/2014 Berner ..... B66B 7/1223 187/391
8,807,286 B2 * 8/2014 Puranen ..... B66B 5/0018 187/391
2009/0038473 A1 * 2/2009 Kwon ..... B03C 3/12 95/3
2016/0325967 A1 * 11/2016 Ou ..... B24B 19/004
2017/0066631 A1 * 3/2017 Mupende ..... B66C 13/16

FOREIGN PATENT DOCUMENTS

GB 2 029 580 A 3/1980
JP 9-202567 A 8/1997
JP 2003-54857 A 2/2003
JP 2003-54858 A 2/2003
JP 2011-37606 A 2/2011
WO WO 2011/144816 A1 11/2011

* cited by examiner

1 - traction sheave
2 - elevator ropes
3 - measuring device
4 - alarm circuit
4a, 4b - conductors
5 - control and operating system

METHOD AND APPARATUS FOR MONITORING THE LUBRICANT CONTENT OF ELEVATOR ROPES

CROSS REFERENCE TO RELATED APPLICATIONS

This application is a Continuation of PCT International Application No. PCT/FI2013/050728, filed on Jul. 2, 2013, which claims priority under 35 U.S.C. 119(a) to Patent Application No. 20125767, filed in Finland on Jul. 2, 2012, all of which are hereby expressly incorporated by reference into the present application.

The object of the invention is a method and an apparatus for monitoring the lubricant content of elevator ropes.

Elevator ropes are lubricated in the manufacturing phase for preventing corrosion and excessive wear. In this case, however, only the amount of lubricant that would retain sufficient friction between the elevator ropes and the rope grooves of the traction sheave is used. Since, however, lubricant collects dust and small particles detaching from normal wear, the original lubrication performed in the manufacturing phase of the elevator ropes is never generally sufficiently good for the whole service life of an elevator rope, but instead the elevator ropes must be lubricated again during their use for preventing excessive wear and the effect wearing the rope pulleys.

One problem in elevator solutions according to prior art is that the drying of elevator ropes is difficult to supervise reliably in advance and for this reason might often even be forgotten altogether. No accurate lubrication interval can be predicted, because the correct lubrication interval depends on many factors, such as e.g. how frequently the elevator is used, the ambient temperature and impurities, the material of the traction sheave and its rope grooves, and also the slipping between the elevator ropes and the traction sheave.

Excessive drying is perhaps only noticed in connection with a servicing visit and if it was not possible to forecast the need for lubrication, the lubrication might then be completely omitted, in which case the aforementioned problem situations increase. Often a need for lubrication can be ascertained only by testing the surface of the elevator ropes with a hand.

Correctly-timed and adequate lubrication of elevator ropes is an extremely important procedure, particularly in new elevators, from the viewpoint of the rope structures and rope pulleys of the elevator. If elevator ropes are not for some reason lubricated according to the instructions and at the correct time, the consequence of excessively dry elevator ropes is rapid and premature wear of the elevator ropes, the traction sheave and the diverting pulleys, and the premature replacement work caused by this, which is expensive and causes unnecessary standstills as well as, via this, also discomfort to users of elevators.

In addition to the aforementioned drawbacks, one problem is that the magnetic and electrically-conductive metal dust detaching from elevator ropes containing too little lubricant and from the traction sheave in connection with wear penetrates e.g. to inside a control cabinet in the machine room or to inside some other elevator device and causes fault situations e.g. in contactors, in the elevator drive system and in other sensitive elevator devices, and also in the worst case might result in, replacement of the whole control cabinet.

The object of aforementioned the present drawbacks invention and to is to eliminate the aforementioned drawbacks and to achieve a simple, operationally reliable and inexpensive method and apparatus for monitoring and supervising the lubricant content of elevator ropes.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

The invention is based on the insight that as the lubricant decreases from the elevator ropes and from contact between the elevator ropes and the traction sheave, the elevator rope and/or traction sheave wears more quickly and also rusting increases. Metal dust and rust detach from the ropes and from the traction sheave, in which case it can be collected with suitable means, e.g. with a magnet, on the observation point for detection. Wear or rusting that starts normally does not require immediate replacement or repair of the ropes or traction sheave. Detachment of metal dust and/or rust is a good indication that there is insufficient lubrication. This indication is utilized in the invention.

One advantage, among others, of the solution according to the invention is that by means of it the lubricant content of elevator ropes can be accurately monitored and an error condition possibly starting can be addressed in advance. Another advantage is that the lubricant content of elevator ropes can be supervised by the aid of a remote monitoring function, in which case the number of inspection visits can be reduced. Another advantage of the solution is that it is simple, operationally reliable and inexpensive to implement.

Figure 2:
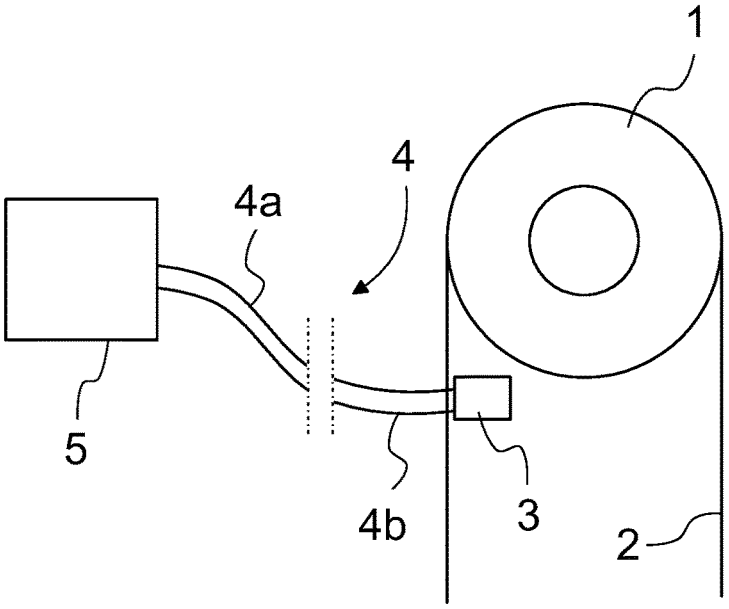
Figure 3:
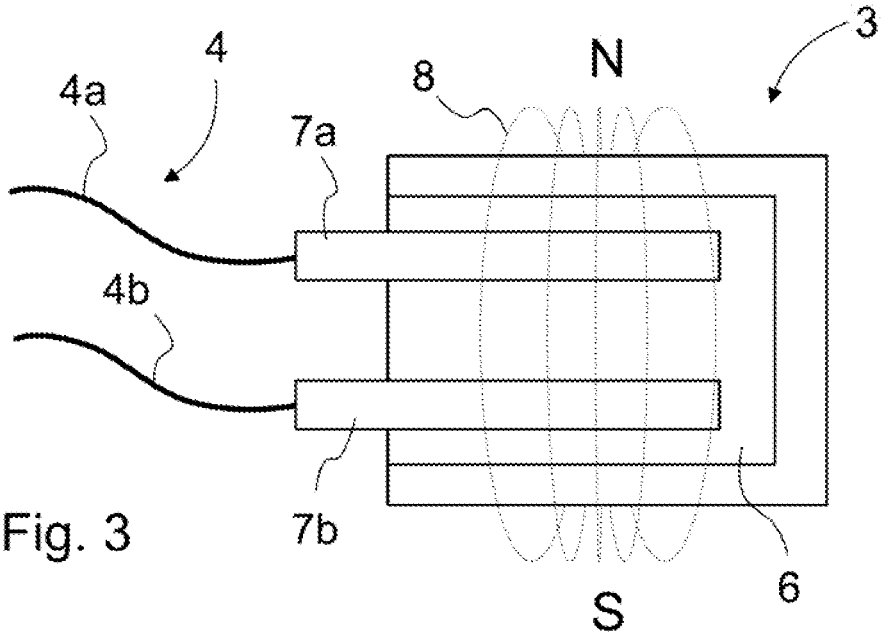
Figure 4:
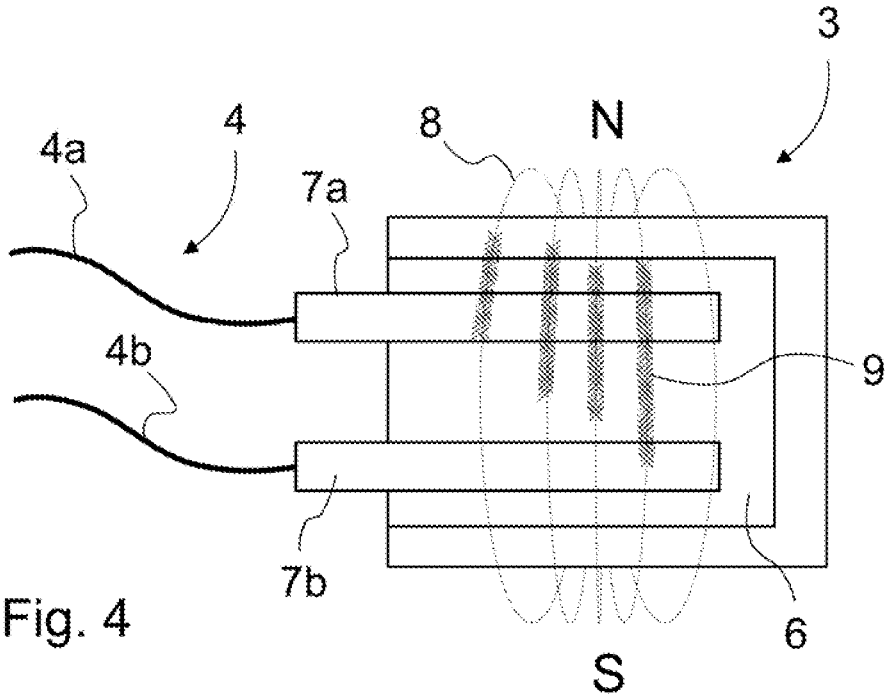

In the following, the invention will be described in more detail by the aid of some examples of its embodiment with reference to the attached drawings, wherein FIG. 1 presents a simplified side view of one solution according to the invention for monitoring the lubricant content of elevator ropes, FIG. 2 presents a simplified side view of one other solution according to the invention for monitoring the lubricant content of elevator ropes, FIG. 3 presents a simplified top view of one measuring device according to the invention for monitoring the lubricant content of elevator ropes in a situation in which there is sufficient lubricant in the elevator ropes and FIG. 4 presents a simplified top view of the measuring device according to FIG. 3 for monitoring the lubricant content of elevator ropes in a situation in which an alarm has been switched on about an insufficient quantity of the lubricant of the elevator ropes.

FIG. 1 presents a simplified side view of one solution according to the invention for monitoring the lubricant content of elevator ropes 2 and for supervising possible drying. The elevator hoisting machine provided with a motor comprises at least a traction-sheave 1, around which one or more elevator ropes 2 are fitted side-by-side, which ropes move under the effect of friction along with the rotational movement of the traction sheave 1 and at the same time move the elevator car. From the effect of the same friction the elevator ropes 2 wear the rope grooves of the traction sheave 1 and at the same time themselves wear, in which case metal dust detaches from the traction sheave 1 and from the elevator ropes 2. The drier the elevator ropes 2 are, the more metal dust and also rust that has been produced detaches.

The solution according to the invention is based on the conclusion that the metal dust detached from the dry elevator ropes 2 and traction sheave 1 is a magnetic material and conducts electricity, in which case by the aid of a suitable measuring device it can be deduced from the quantity of metal dust when the elevator ropes 2 are so dry that they must be lubricated. For this purpose a measuring device 3 is disposed in the immediate proximity of the traction sheave 1 and the elevator ropes 2, which measuring device is arranged to measure the amount of metal dust detaching from the traction sheave 1 and from the elevator ropes 2 in connection with wear. The measuring device 3 is connected to the control & operating system 5 of the elevator, e.g. by the aid of the conductors 4*a*, 4*b*, which together with the measuring device 3 and the control & operating system 5 of the elevator form an alarm circuit 4. The measuring device 3 is preferably a permanent magnet, to which the metal dust detaching from the traction sheave 1 and from the elevator ropes 2 in connection with wear attaches by the aid of magnetic forces. When a sufficient amount of metal dust has collected on the surface of the measuring device 3, the measuring device 3 gives alarm data to the control & operating system 5 of the elevator, in which system the alarm data is processed e.g. by stopping the elevator and/or by sending the data onwards to an alarm center for the elevator.

In the solution according to FIG. 1 the measuring device 3 is in the immediate proximity of the traction sheave 1 and the elevator ropes 2 essentially at the side of the traction sheave 1 and at the point of the plane of rotation of the traction sheave 1 and also outside the elevator ropes 2. Correspondingly, in the second solution of FIG. 2 according to the invention, the measuring device 3 is in the immediate proximity of the traction sheave 1 and the elevator ropes 2 essentially below the traction sheave 1 and at the point of the plane of rotation of the traction sheave 1 and also between the elevator ropes 2 ascending to the traction sheave 1 and the elevator ropes 2 descending from the traction sheave 1.

FIGS. 3 and 4 present e.g. a simplified top view of one measuring device 3, functioning as a sensing means, according to the invention for monitoring and supervising the lubricant content of elevator ropes 2 and for issuing an alarm about insufficient lubricant content. In the situation according to FIG. 3, the elevator ropes 2 have sufficient lubricant, e.g. the elevator ropes 2 have just been installed or they have been re-lubricated and the measuring device 3 has been placed in its original state to measure future use. Correspondingly, in the situation according to FIG. 4, the elevator ropes 2 have dried to the extent that so much metal dust detached in connection with wear of the traction sheave 1 and of the elevator ropes 2 has adhered to the measuring device 3 that an alarm about the quantity of the lubricant of the elevator ropes 2 being too low has been switched on and sent to the control & operating system 5 of the elevator.

The measuring device 3 is e.g. a permanent magnet, onto one surface of which insulation 6 is fixed, on top of which insulation elongated conductor means 7*a*, 7*b*, e.g. metal strips, that conduct electricity are fixed at a distance from each other. The conductor means 7*a*, 7*b* are connected to the control & operating system 5 of the elevator, into an alarm circuit 4, by the aid of the conductors 4*a*, 4*b*. The alarm current circuit, i.e. the alarm circuit 4, travels from the first conductor means 7*a* along the first-conductor 4*a* to the control & operating system 5 of the elevator and returns from there along the second conductor 4*b* to the second conductor means 7*b*. In a normal situation, when the elevator ropes 2 have sufficient lubricant, the alarm circuit is cut between the first conductor means 7*a* and the second conductor means 7*b*.

The conductor means 7*a*, 7*b* are disposed transversely against the magnetic flux of the permanent magnet of the measuring device 3, in which case the magnetic flux flows from the N-pole of the magnet via the conductor means 7*a* and 7*b* to the S-pole of the magnet. The magnetic flux is presented in FIGS. 3 and 4 with magnetic force lines 8.

In FIG. 3 there is no metal dust, detached in connection with wear, between the conductor means 7*a* and 7*b* yet, so the alarm circuit is cut between the conductor means 7*a* and 7*b*. On the other hand, in the situation according to FIG. 4 metal dust that has detached in connection with wear has adhered to the surface of the permanent magnet of the measuring device 3 and settled on the surface in the direction of the force lines 8 of the magnetic flux. In one point there is so much metal dust that it extends from the first conductor means 7*a* to the second conductor means 7*b*, forming an electrically-conductive bridge 9 between the conductor means 7*a* and 7*b*. In this case the alarm circuit closes and the measuring device 3 gives an alarm to the control & operating system 5 of the elevator about the amount of lubricant of the elevator ropes 2 being insufficient.

With the method according to the invention the lubricant content of elevator ropes 2 is monitored and supervised e.g. as follows. At the start of supervision, the measuring device 3 is connected to the control & operating system 5 of the elevator or to a corresponding unit, and it is ensured that there is no metal dust at least between the conductor means 7*a* and 7*b*. The metal dust detaching in connection with wear of the traction sheave 1 and of the elevator ropes 2 during operation of the elevator is collected in the measuring device 3, e.g. on the surface of it, until there is so much metal dust that the metal dust connects the conductor means 7*a*, 7*b* or corresponding means to each other, in which case an alarm is switched on and sent to the control & operating system 5 of the elevator.

The insulation 6 can be e.g. one-sided or two-sided tape, which is easily detachable-when cleaning the measuring device 3 after an alarm or otherwise as needed. For example, when two-sided tape is the insulation 6, the whole insulation 6 can be replaced in connection with cleaning. In addition, the metal strips or flexible strips containing conductor metal that are the conductor means 7*a*, 7*b* can easily be replaced for new ones if necessary.

Calibration and adjustment of the measuring device 3 can be performed e.g. by varying the distance between the conductor means 7*a* and 7*b*, by changing the disposal location of the measuring device 3 or also with a software program in such a way that sufficiently accurate information about when the amount of lubricant of the elevator ropes 2 is so low that they must be re-lubricated is obtained as a result.

It is obvious to the person skilled in the art that the invention is not limited solely to the examples described above, but that it may be varied within the scope of the claims presented below. Thus, for example, the metal dust collected can be used otherwise than just for switching on a circuit. For giving an alarm, e.g. the magnetic field of the measuring device can be measured, the value of which magnetic field changes when enough metal dust has collected on the surface of the measuring device.

It is further obvious to the person skilled in the art that for giving an alarm, e.g. the pattern from the detached metal dust and/or the amount of metal dust that has collected on the surface of the measuring device can be measured optically, in which case an alarm can be effected according to a change in the pattern and/or the amount.

It is further obvious to the person skilled in the art that the measuring device can also be disposed in another way with respect to the traction sheave and to the elevator ropes than what is presented above. Additionally, there can be two or more measuring devices instead of one.

It is also obvious to the person skilled in the art that the measuring device can comprise an electromagnet instead of a permanent magnet.

It is also obvious to the person skilled in the art that the cleaning phase of the measuring device can also be performed in such a way that the magnetism of the measuring device is removed during the cleaning and is returned again after the cleaning. This facilitates carrying out cleaning.

The invention claimed is:

1. A method for monitoring and supervising the lubricant content of elevator ropes in an elevator, the elevator comprising at least a hoisting machine provided with a drive motor, the hoisting machine comprising at least a traction sheave, one or more elevator ropes being fitted side-by-side around the traction sheave, the one or more elevator ropes moving under the effect of friction along with the rotational movement of the traction sheave and at the same time moving the elevator car, said method comprising the steps of:

monitoring and supervising the lubricant content of the elevator ropes by the aid of a measuring device by:

collecting in the measuring device the metal dust and/or rust detaching in connection with wear of the traction sheave and of the elevator ropes during operation of the elevator; and letting the metal dust and/or rust switch on an alarm about a lubricant content of the elevator ropes that is too low.

2. The method according to claim 1, further comprising the step of collecting the metal dust and/or rust detaching in connection with wear of the traction sheave and of the elevator ropes during operation of the elevator in a permanent magnet that is in the measuring device.

3. The method according to claim 1, further comprising the step of collecting the metal dust and/or rust detaching in connection with wear of the traction sheave and of the elevator ropes during operation of the elevator on the surface of a permanent magnet that is in the measuring device to electrically close an open alarm circuit connected to the control and operating system of the elevator.

4. The method according to claim 1, further comprising the steps of:

collecting the metal dust and/or rust detaching in connection with wear of the traction sheave and of the elevator ropes during operation of the elevator on the surface of a permanent magnet that is in the measuring device;

measuring the pattern formed by, and/or the amount of, the metal dust and/or rust optically; and effecting an alarm in the control and operating system of the elevator on the basis of a change in the pattern and/or amount.

5. The method according to claim 1, further comprising the steps of:

collecting the metal dust and/or rust detaching in connection with wear of the traction sheave and of the elevator ropes during operation of the elevator on a permanent magnet that is in the measuring device;

measuring a magnetic field of the measuring device; and effecting an alarm in the control and operating system of the elevator on the basis of a change in the value of the magnetic field.

6. The method according to claim 1, further comprising the step of collecting the metal dust and/or rust detaching in connection with wear of the traction sheave and of the elevator ropes during operation of the elevator on the surface of insulation that is on the surface of the measuring device.

7. The method according to claim 1, further comprising the steps of:

using two-sided tape as the insulation; and in connection with cleaning of the measuring device, detaching the insulation and, if necessary, replacing the insulation with a new one.

8. An apparatus for monitoring and supervising the lubricant content of elevator ropes in an elevator, the elevator comprising at least a hoisting machine provided with a drive motor, the hoisting machine comprising at least a traction sheave, one or more elevator ropes being fitted side-by-side around the traction sheave, the one or more ropes moving under the effect of friction along with the rotational movement of the traction sheave and at the same time moving the elevator car, said apparatus comprising:

at least one measuring device for monitoring and supervising the lubricant content of the elevator ropes, said at least one measuring device being disposed in the proximity of the traction sheave and the elevator ropes and collecting the metal dust and/or rust detaching in connection with wear of the traction sheave and of the elevator ropes during operation of the elevator.

9. The apparatus according to claim 8, wherein the measuring device is disposed in the immediate proximity of the traction sheave and the elevator ropes to the side of the traction sheave and essentially at the point of the plane of rotation of the traction sheave and also outside the elevator ropes.

10. The apparatus according to claim 8, wherein the measuring device is disposed in the immediate proximity of the traction sheave and the elevator ropes essentially below the traction sheave and essentially at the point of the plane of rotation of the traction sheave and also between the elevator ropes ascending to the traction sheave and the elevator ropes descending from the traction sheave.

11. The apparatus according to claim 8, wherein the measuring device comprises at least a magnet collecting the metal dust and/or rust detaching in connection with wear of the traction sheave and of the elevator ropes during operation of the elevator.

12. The apparatus according to claim 11, wherein on the surface of the magnet of the measuring device are elongated conductors of the alarm circuit between the measuring device and the control and operating system of the elevator, the conductors being insulated from each other and at a distance from each other and also at essentially a right angle to the magnetic flux of the measuring device.

13. The apparatus according to claim 12, wherein the conductors are detachable and replaceable and they are insulated from the surface of the magnet of the measuring device with insulation.

14. The apparatus according to claim 12, wherein the distance between the conductors in the direction of the force lines of the magnetic flux of the measuring device is selected in such a way that when the concentration of the amount of lubricant of the elevator ropes decreases to a level predefined as too low, the metal dust and/or rust that has detached in connection with wear of the traction sheave and of the elevator ropes during operation of the elevator has adhered to the surface of the magnet of the measuring device to form an electrically-conductive bridge in essentially the direction of the force lines between the conductors for closing the alarm circuit.

15. The apparatus according to claim 8, wherein the apparatus comprises an optical measuring device for optically measuring the pattern formed by, and/or the amount of, the metal dust and/or rust collected in connection with wear of the traction sheave and of the elevator ropes during operation of the elevator on the surface of the permanent magnet that is in the measuring device.

16. The apparatus according to claim 8, wherein the apparatus comprises a measuring mechanism configured to measure a magnetic field of the measuring device for measuring a change in the value of the magnetic field of the measuring device caused by the metal dust and/or rust that has collected in connection with wear of the traction sheave and of the elevator ropes during operation of the elevator and that has adhered to the permanent magnet that is in the measuring device.

17. The apparatus according to claim 11, wherein the magnet is a permanent magnet or an electromagnet.

18. The apparatus according to claim 13, wherein the conductors are detachable and replaceable and they are insulated from the surface of the magnet of the measuring device with two-sided tape.

19. The method according to claim 2, further comprising the step of collecting the metal dust and/or rust detaching in connection with wear of the traction sheave and of the elevator ropes during operation of the elevator on the surface of a permanent magnet that is in the measuring device to electrically close an open alarm circuit connected to the control and operating system of the elevator.

20. The method according to claim 2, further comprising the steps of:

collecting the metal dust and/or rust detaching in connection with wear of the traction sheave and of the elevator ropes during operation of the elevator on the surface of the permanent magnet that is in the measuring device measuring the pattern formed by, and/or the amount of, the metal dust and/or rust optically; and effecting an alarm in the control and operating system of the elevator on the basis of a change in the pattern and/or amount.

* * * * *